US006159048A

United States Patent [19]

Van Koetsem et al.

[11] Patent Number: 6,159,048

[45] Date of Patent: Dec. 12, 2000

[54] CONNECTOR FOR HIGH FREQUENCY SIGNALS

[75] Inventors: Jan Peter Karel Van Koetsem, Zwijndrecht; Gert Droesbeke, Nijlen; Luc Van Den Torren, Bonheiden, all of Belgium

[73] Assignee: Framatome Connectors International, Courbevoie, France

[21] Appl. No.: 09/339,766

[22] Filed: Jun. 24, 1999

[30] Foreign Application Priority Data

Jun. 30, 1998 [NL] Netherlands ..... 1009529

[51] Int. Cl.[7] ..... H01R 13/648

[52] U.S. Cl. ..... 439/608

[58] Field of Search ..... 439/608, 101, 439/943, 660, 682, 78, 109, 689, 701, 603

[56] References Cited

U.S. PATENT DOCUMENTS

| | | | |
|---|---|---|---|
| 3,721,869 | 3/1973 | Paoli | 317/256 |
| 3,774,142 | 11/1973 | Siegler | 439/109 |
| 4,451,107 | 5/1984 | Dola et al. | 339/143 R |
| 5,261,829 | 11/1993 | Fusselman et al. | 439/108 |
| 5,286,212 | 2/1994 | Broeksteeg | 439/108 |
| 5,342,211 | 8/1994 | Broeksteeg | 439/108 |
| 5,417,588 | 5/1995 | Olson et al. | 439/585 |
| 5,564,948 | 10/1996 | Harting et al. | 439/607 |
| 5,639,263 | 6/1997 | Zell et al. | 439/608 |
| 5,647,768 | 7/1997 | Messuri et al. | 439/620 |
| 5,743,765 | 4/1998 | Andrews et al. | 439/608 |
| 5,785,534 | 11/1999 | Longueville et al. | 439/65 |
| 5,803,768 | 9/1998 | Zell et al. | 439/608 |
| 5,980,271 | 11/1999 | MacDougall et al. | 439/78 |
| 6,012,927 | 1/2000 | Longueville et al. | 439/65 |

FOREIGN PATENT DOCUMENTS

| | | |
|---|---|---|
| 0693795 A1 | 1/1996 | European Pat. Off. . |
| 2693845 | 1/1994 | France . |
| 967325 | 8/1964 | United Kingdom . |

*Primary Examiner*—Brian Sircus
*Assistant Examiner*—Son V. Nguyen
*Attorney, Agent, or Firm*—Perman & Green, LLP

[57] ABSTRACT

A connector for high frequency signals comprises a housing of insulating material and a plurality of male contact elements. The housing has a bottom and two opposite side walls extending upwardly from the bottom, the bottom and side walls determining a receiving space. The bottom is provided with cavities regularly arranged in rows and columns. Each of the contact elements is mounted in a cavity, an upper end of each contact element projecting into the receiving space. At least a plurality of the cavities are metallized at their the inner walls and the contact elements are mounted in the metallized cavities by means of at least one support element of insulating material. Each support element comprises a body having an outer dimension which is smaller than the inner dimension of the corresponding cavity, and a plurality of ledges extending mainly in axial direction of the contact element and determining an outer dimension which is larger than the inner dimension of the corresponding cavity.

9 Claims, 3 Drawing Sheets

CONNECTOR FOR HIGH FREQUENCY SIGNALS

The invention relates to a connector for high frequency signals, comprising a housing of insulating material and a plurality of male contact elements, said housing having a bottom and two opposite side walls extending upwardly from the bottom, the bottom and side walls determining a receiving space, wherein the bottom is provided with cavities regularly arranged in rows and columns, wherein each of the contact elements is mounted in a cavity, an upper end of each contact element projecting into the receiving space.

In a connector of the above-mentioned type it is known to use a number of the male contact elements as ground contact elements to provide a shielding for the signal contact elements. In this manner the number of contact elements which can be used as signal contact elements significantly decreases so that the signal density of the connector is relatively low.

The invention aims to provide an improved connector of the above-mentioned type.

To this end the connector of the invention is characterized in at least a plurality of the cavities are metallized at their the inner walls, wherein the contact elements are mounted in the metallized cavities by means of at least one support element of insulating material, wherein each support element comprises a body having an outer dimension which is smaller than the inner dimension of the corresponding cavity, and a plurality of ledges extending mainly in axial direction of the contact element and determining an outer dimension which is larger than the inner dimension of the corresponding cavity.

In this manner a connector is obtained, wherein the contact elements mounted in the metallized cavity are completely shielded so that each contact element can be used as a signal contact element and a high signal density is obtained. Moreover the size of the connector housing and the pitch of the contact elements can be the same as in the known connector so that the connector of the invention can be used in an interchangeable manner within existing connector families. Further, as the size of the support elements and dimension of the cavities can be chosen such that any play is received by the ledges, manufacturing tolerances of the connector are not increased. The contact elements will always be mounted in a fixed manner within the cavities at the desired location.

According to a preferred embodiment the inner wall of each cavity and said at least one support element of the corresponding contact element are provided with cooperating locking means for locking the contact element in the cavity. In this manner the fixed mounting of the contact elements in the cavities is further improved.

The invention will be further explained by reference to the drawings in which an embodiment of the connector of the invention is schematically shown.

Figure 1:
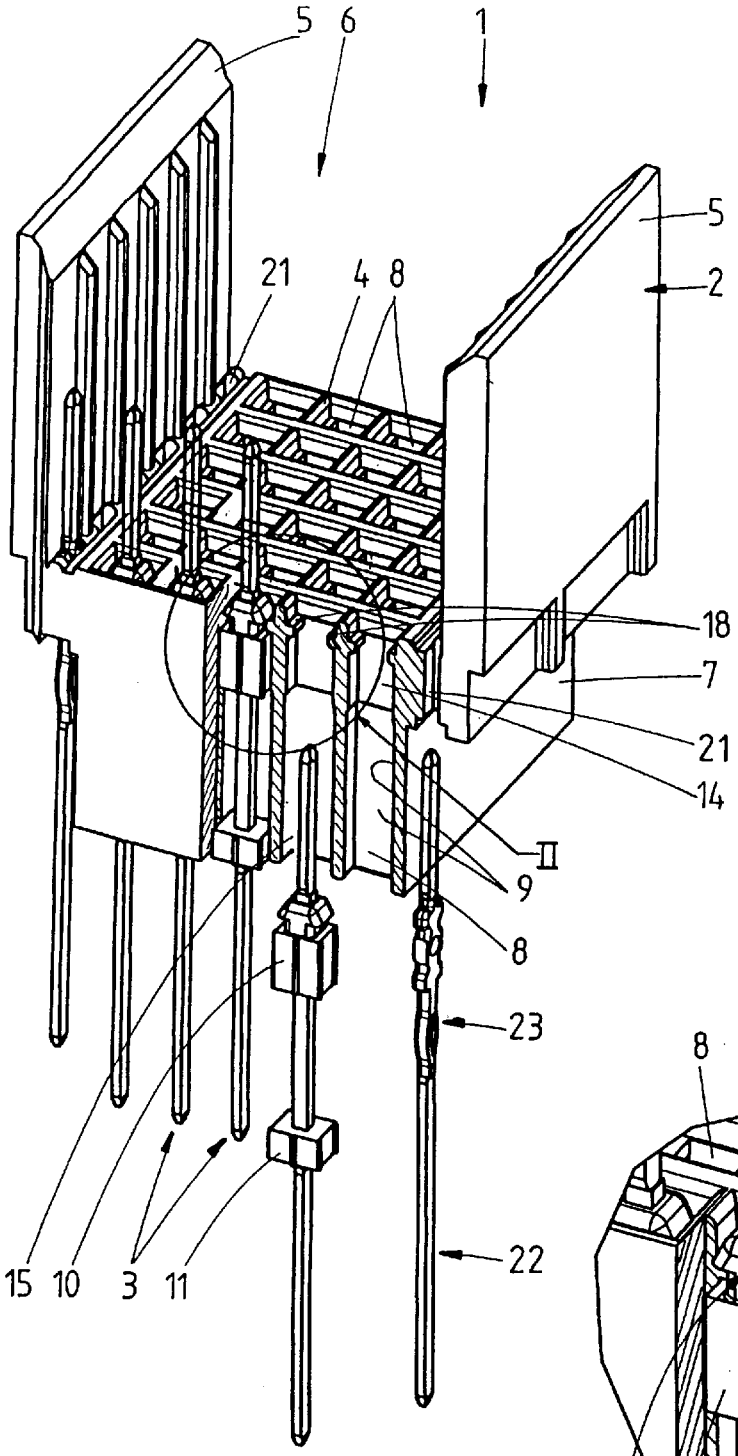
FIG. 1 shows a perspective view of an embodiment of the connector according to the invention, wherein the housing is partly broken away to show the mounting of the contact elements.

FIG. 1 shows a connector 1, comprising a housing 2 of insulating material and a plurality of male contact elements 3 regularly arranged in rows and columns at a given pitch in a conventional manner. Only a few contact elements 3 are shown in the drawings for the sake of clarity. The housing 2 is provided with a bottom 4 and two opposite side walls 5, extending upwardly from the bottom 4. The bottom 4 and side walls 5 determine a receiving space 6 for receiving a female connector with female contact elements not shown.

In the embodiment shown, the bottom 4 of the housing 2 has a lower bottom extension 7 directed away from the receiving space 6. This bottom extension 7 can be received in a slot of a printed circuit board as will be explained hereinafter. The bottom 4 is provided with cavities 8 regularly arranged in rows and columns for receiving the contact elements 3. The cavities 8 extend through the complete bottom 4 with extension 7. The cavities 8 are metallized at their inner walls 9, in that the complete housing 2 is metallized in the embodiment described. The contact elements 3 are mounted in the metallized cavities 8 by means of two support elements 10, 11 of insulating material, wherein the first support element 10 is arranged near the receiving space 6 and the second support element 11 is arranged near the lower end of the extension 7. In this manner a very stable support of the contact elements 3 within their cavities 8 is guaranteed.

Figure 2:
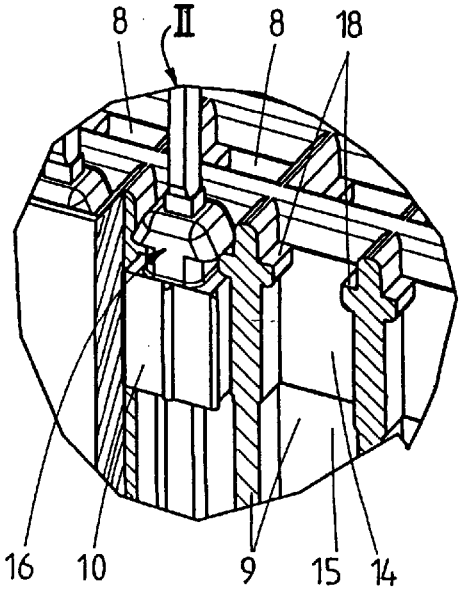
FIG. 2 shows detail II of FIG. 1 at a larger scale.
Figure 4:
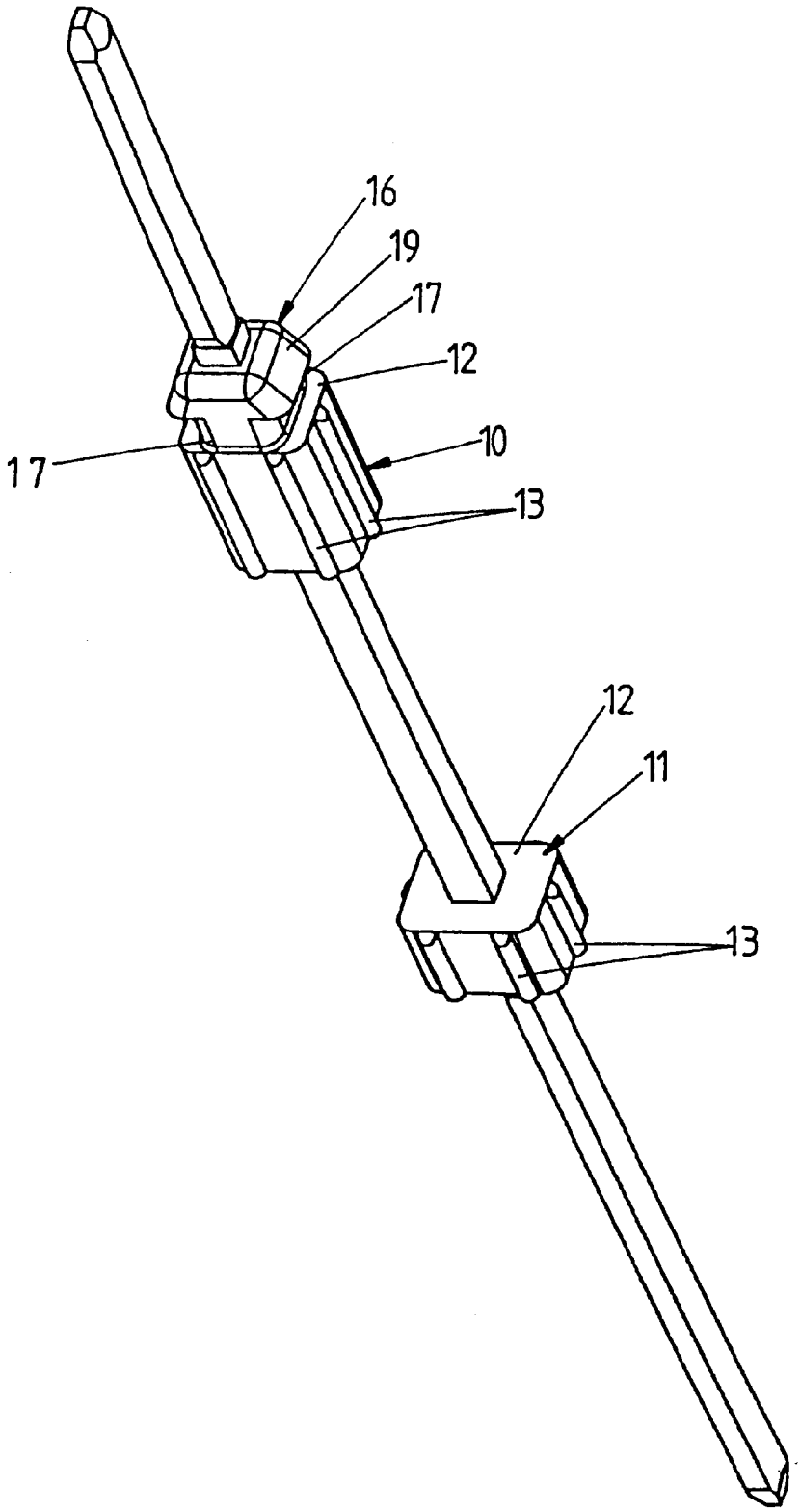
FIG. 4 shows a perspective view of a contact element with support elements of the connector of FIG. 1.

As shown at a larger scale in FIGS. 2 and 4, each support element 10, 11 comprises a body 12 with a plurality of ledges 13 extending in axial direction of the contact element 3. The dimensions of the body 12 of a support element 10, 11 and the cavity 8 are such that the bodies 12 can always be received with play within the cavity 8 despite any tolerances. The outer dimension determined by the ledges 13 is such that only these ledges 13 are clampingly received within the cavity 8, thereby providing an accurate mounting of the contact elements 3 within the cavities 8.

Figure 3:
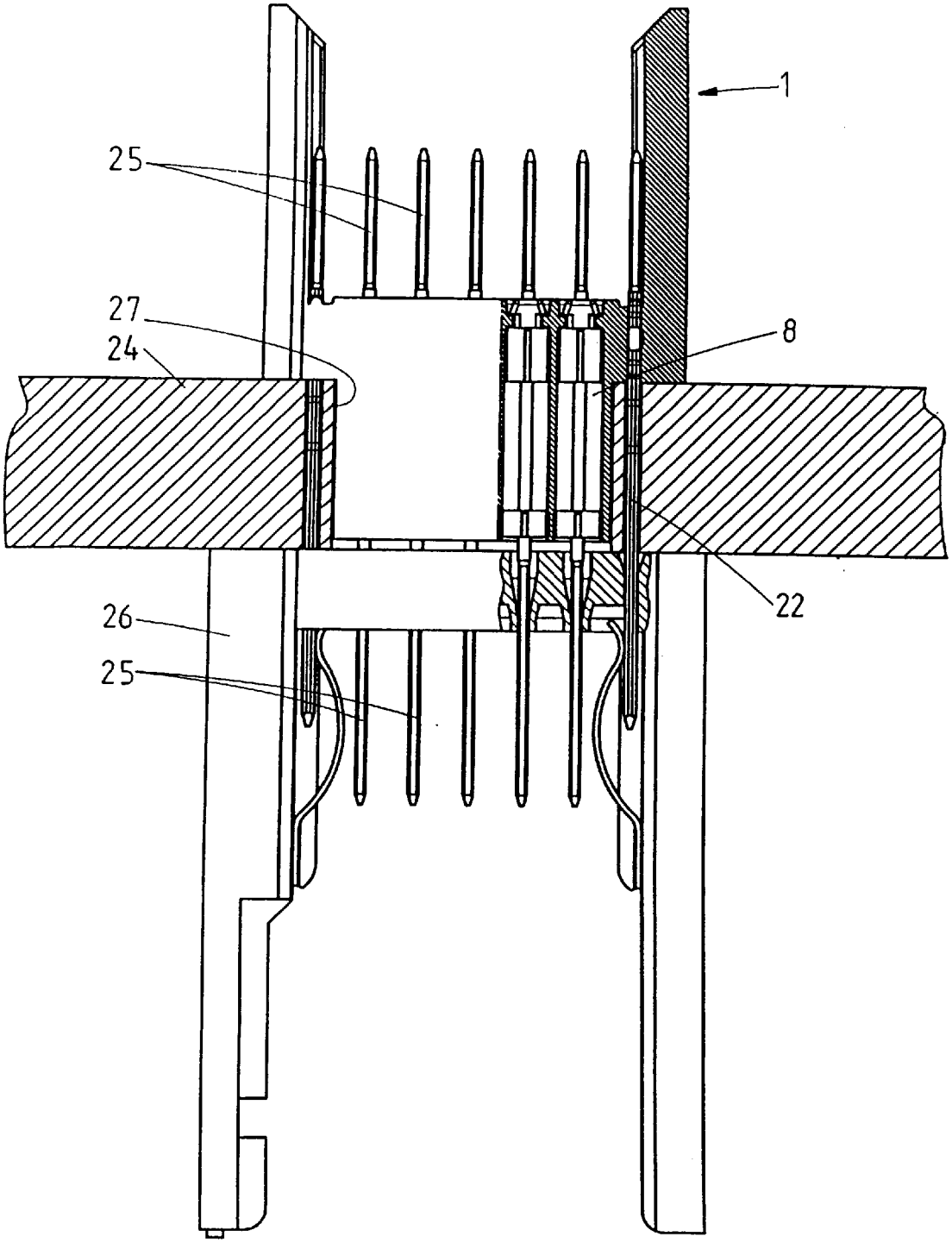
FIG. 3 is a cross section of the connector of FIG. 1 mounted on a printed circuit board.

In the embodiment shown in FIGS. 1–3, each metallized cavity 8 has an upper section 14 near the receiving space 6 having a smaller inner dimension than the remaining part 15 of the cavity 8. The ledges 13 of the first support element 10 determine a dimension which is smaller than the inner dimension of the part 15 of the cavity 8, so that during manufacturing the first support element 10 can pass with play through this part 15 of the cavity. However this dimension determined by the ledges 13 of the first support element 10 is larger than the inner dimension of the upper section 14 so that the support element 10 is clamped within this upper section. The ledges 13 of the second support element 11 determine a dimension which is larger than the inner dimension of the remaining part 15 of the cavity 8, so that the second support element 11 is also clamped within this remaining part 15.

The first support element 10 of the contact elements 3 is provided with a head part 16 for locking the contact element 3 within the cavity 8. The locking action is obtained by providing the head part 16 with slots 17 at opposite sides and by providing ledges 18 at opposite sides protruding into the cavity 8 at the upper section 14 near the receiving space 6. To facilitate mounting of the contact elements 3 within the cavities 8, the head part 16 is provided with oblique faces 19 extending outwardly and downwardly from near the contact pin 3 towards the slots 17. The head part 16 co-operating with the ledges 18 and the support elements 10, 11 with their ledges 13 provide for a very stable mounting of the contact elements 3 within the cavities 8.

The described way of mounting the contact elements 3 has the advantage that the forces exerted on the contact elements can be determined in a defined manner and the forces exerted during mounting of a conventional shroud will be received mainly by the head part of the support elements.

In the embodiment of FIGS. 1–3 all cavities 8 are made as coax cavities, i.e. each cavity 8 receives one contact element 3. In an alternative embodiment not shown some cavities can be made as twinax cavities, i.e. cavities receiving two contact elements 3. In such a case each column of cavities may include two twinax cavities at each side of a center cavity receiving one contact element 3. Of course other arrangements of cavities are possible.

In the embodiment shown, a row of cavities 21 is provided at each side of the rows of metallized cavities 8, which cavities 21 are made as standard cavities for receiving standard contact elements 22 as shown in FIG. 3. These contact elements 22 are used as ground contact elements which contact the metallization of the cavities 21 and are provided with press-fit sections 23 for connection to a printed circuit board 24. The press-fit sections 23 of the contact elements 22 further provide for a mounting of the connector 1 on the printed circuit board 24.

All contact elements 3, 22 are provided with male contact sections 25 at their upper and lower sides, wherein a conventional shroud 26 is mounted on the contact sections 25 opposite of the receiving space 6. The bottom extension 7 is received within a slot 27 in the printed circuit board 24.

It will be understood that the connector 1 can also be made without the bottom extension 7 and in such an embodiment 1 a first support element 10 will be sufficient for mounting the contact elements 3 within the cavities 8. It is further noted that instead of male contact sections 25 at the side opposite of the receiving space 6, the contact elements 3, 22 could be provided with other type of terminal ends.

From the foregoing it will be understood, that the connector described shows the advantage that an accurate and stable mounting of the contact elements 3 within the cavities 8, is possible without the requirement of high tolerances for the cavities 8 and support elements 10, 11. Further a complete shielding of the contact elements 3 by the metallized cavities 8, is obtained, so that all contact elements can be used as signal contact elements resulting in a high signal density. The connector 1 can be used in an interchangeable manner within existing connector families as the connector can be manufactured with the same dimensions and same pitch of contact elements as conventional connectors.

The invention is not restricted to above described embodiments which can be varied in a number of ways within the scope of the claims.

What is claimed is:

1. A connector for high frequency signals, comprising a housing of insulating material and a plurality of male contact elements, said housing having a bottom and two opposite side walls extending upwardly from the bottom, the bottom and the side walls determining a receiving space, wherein the bottom is provided with cavities regularly arranged in rows and columns, wherein each of the contact elements is mounted in a cavity, an upper end of each contact element projecting into the receiving space, wherein at least a plurality of the cavities are metallized at their inner walls to provide metallized cavities, wherein the contact elements are mounted in the metallized cavities by means of at least one support element of insulating material, wherein each support element comprises a body having an outer dimension which is smaller than an inner dimension of a corresponding cavity, and a plurality of spaced apart ledges extending mainly in an axial direction of the contact element and determining an outer dimension which is larger than the inner dimension of the corresponding cavity, wherein an inner wall of each cavity and said at least one support element of a corresponding contact element is provided with cooperating locking means for locking the contact element in the cavity, and wherein an inner wall of each metallized cavity is provided with two opposite protruding ledges and each corresponding support element is provided with a head part having slots at opposite sides for receiving the protruding ledges.

2. The connector according to claim 1, wherein the head part is provided with oblique faces extending outwardly and downwardly from the contact element towards said slots.

3. The connector according to claim 1, wherein each support element is fixed to a corresponding contact element, preferably by overmoulding.

4. The connector according to claim 1, wherein the housing is completely metallized.

5. The connector according to claim 1, wherein said terminals of the ground contact elements are made as press-fit terminals.

6. The connector according to claim 1, wherein a row of ground contact cavities is provided along each opposing side of the rows of metallized cavities, wherein male ground contact elements are mounted in the ground contact cavities, said ground contact elements contacting metallization in the metallized cavities and having terminals for connection to a printed circuit board.

7. A connector for high frequency signals, comprising a housing of insulating material and a plurality of male contact elements, said housing having a bottom and two opposite side walls extending upwardly from the bottom, the bottom and the side walls determining a receiving space, wherein the bottom is provided with cavities regularly arranged in rows and columns, wherein each of the contact elements is mounted in a cavity, an upper end of each contact element projecting into the receiving space, wherein at least a plurality of the cavities are metallized at their inner walls to provide metallized cavities, wherein the contact elements are mounted in the metallized cavities by means of at least two support element, of insulating material, wherein each support element comprises a body having an outer dimension which is smaller than an inner dimension of a corresponding cavity, and a plurality of ledges extending mainly in an axial direction of the contact element and determining an outer dimension which is larger than the inner dimension of the corresponding cavity and wherein the bottom of the housing has a lower bottom extension directed away from the receiving space, wherein said metallized cavities extend through the bottom extension, and wherein each contact element is mounted in a metallized cavity by means of at least two support elements, a first support element being arranged adjacent the receiving space and a second support element being arranged adjacent a lower end of the extension.

8. The connector according to claim 7, wherein each metallized cavity has an upper section near the receiving space, said upper section having a smaller inner dimension than a remaining part of the cavity, wherein the first support element includes ledges which determine a dimension which is smaller than an inner dimension of said remaining part of the cavity and larger than an inner dimension of said upper section, wherein the second support element includes ledges which determine a dimension which is larger than the inner dimension of said remaining part of the cavity.

9. The connector according to claim 7, wherein each first support element and the corresponding cavity are provided with cooperating locking means.

* * * * *